United States Patent [19]

Hauk

[11] Patent Number: 4,854,967

[45] Date of Patent: Aug. 8, 1989

[54] PROCESS FOR PRODUCING CARBURIZED SPONGE IRON

[75] Inventor: Rolf Hauk, Düsseldorf, Fed. Rep. of Germany

[73] Assignee: Korf Engineering GmbH, Dusseldorff, Fed. Rep. of Germany

[21] Appl. No.: 786,691

[22] Filed: Oct. 11, 1985

[30] Foreign Application Priority Data

Oct. 12, 1984 [DE] Fed. Rep. of Germany ..... 34379134

[51] Int. Cl.[4] ..... C21B 11/00; C21B 13/02

[52] U.S. Cl. ..... 75/34; 75/38; 75/40; 75/91; 266/160

[58] Field of Search ..... 75/34, 35, 40, 38, 91; 266/900, 160

[56] References Cited

U.S. PATENT DOCUMENTS

| | | | |
|---|---|---|---|
| 3,511,643 | 5/1970 | Vallak et al. | 75/40 |
| 4,268,303 | 5/1981 | Kaneko et al. | 75/34 |
| 4,584,016 | 4/1986 | Becerra Novoa et al. | 75/35 |

*Primary Examiner*—Melvyn J. Andrews

[57] ABSTRACT

A process for producing sponge iron from iron ore is described, which is reduced to sponge iron in a reduction shaft furnace by means of a hot reduction gas. For this purpose reduction gas at a temperature in the range 750 to 900° C. is introduced into shaft furnace (1) level with bustle plane (5) having been produced in a gasifier (2) then cooled and purified in a cyclone separator (12). Reduction gas is introduced below the bustle plane (5) at a temperature below that of the reduction gas introduced in the bustle plane and is preferably introduced into the shaft furnace (1) between 650° and 750° C. Increased carburization of the sponge iron is obtained. Increased carbon separation also results through a volume increase, particularly by increasing the cross-section through the lower part of the shaft furnace. Carburization is also assisted in that the ratio of the reduction gas quantity supplied below the bustle plane is made as large as possible compared with the reduction gas quantity supplied in the bustle plane.

8 Claims, 2 Drawing Sheets

PROCESS FOR PRODUCING CARBURIZED SPONGE IRON

Figure 1:
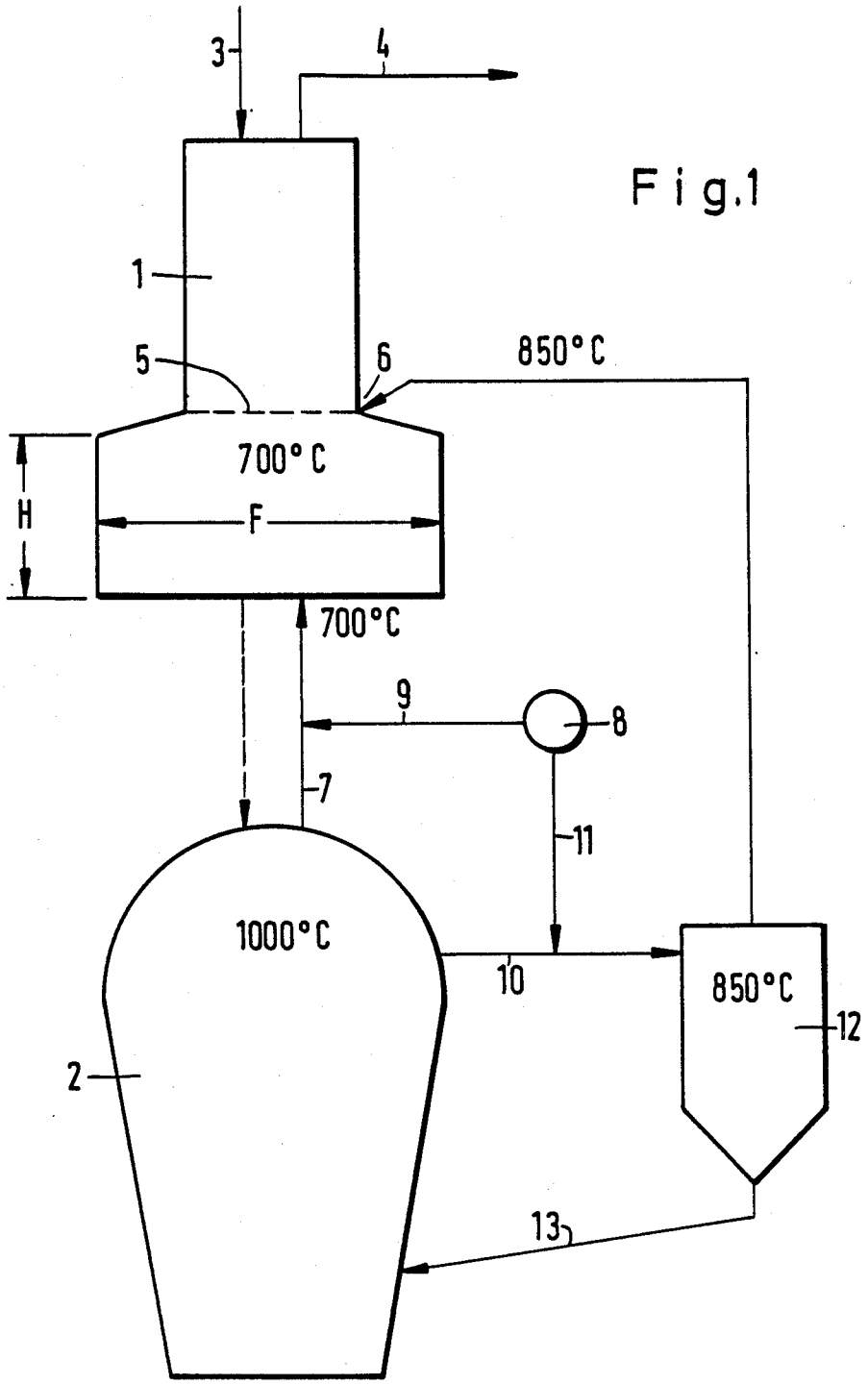

The present invention relates to a process for producing sponge iron or pig iron from iron ore reduced in a reduction shaft furnace by means of a hot reduction gas to sponge iron, which is introduced into the shaft furnace level with the bustle plane at a temperature in the range between 750° and 900° C. as well as below the bustle plane, together with an apparatus for performing this process.

Such a process and apparatus are known from German Pat. No. 30 34 539. In this case, hot reduction gas is produced in a melt-down gasifier below the reduction shaft furnace and following cooling is introduced into said furnace via a central gas inlet and via the furnace outlets connected to the melt-down gasifier. The introduction via the outlets is a necessary consequence of the direct connection of the lower part of the reduction shaft furnace and the melt-down gasifier via downcomers for transferring the sponge iron into the gasifier without the use of sluices or cut-off devices. Thus, every effort is made to make as small as possible to reduction gas quantity supplied via the outlets as compared with the reduction gas quantity supplied by the central inlet by correspondingly setting the flow resistances. Both gas flows are cooled to the extent that they have a temperature of 760° to 850° C. on entering the reduction shaft furnace. In the known process and the apparatus used for this, no special measures are taken to increase the carbon content of the pig iron or sponge iron produced. However, there is often an interest in having a pig iron with a high carbon content and it is a prerequisite for this that the previously reduced iron ore, i.e. the sponge iron has a corresponding carburization. The problem of the present invention is therefore to provide a process and an apparatus of the aforementioned type, in which a carbon-rich sponge iron is obtained.

According to the inventive process this problem is solved in that for increasing the carbon content of the sponge iron or pig iron, the temperature of the reduction gas introduced below the bustle plane is set to a value below the temperature of the reduction gas introduced level with the bustle plane. The temperature of the reduction gas introduced below the bustle plane is preferably set to a value within the range approximately 650° to 850° C. According to an advantageous further development of this process, the residence time of the reduced iron ore in the area between the bustle plane and the plane of the inlets for the reduction gas located below the bustle plane is made as large as possible. There is also preferably a maximum ratio between the quantity of the reduction gas supplied below the bustle plane to the reduction gas quantity supplied level with said plane.

In the apparatus for performing the present process, the problem is solved in that the shaft furnace has a larger cross-section in the area below the bustle plane and the reduction gas inlets below said plane than above said plane. Preferably the line path for the reduction gas supplied below the bustle plane has a minimum resistance and the distance between the bustle plane and the plane of the reduction gas inlets located below said plane is as small as possible. The carbon addition or attachment to the inner surface of the sponge iron takes place via the reaction

| | |
|---|---|
| $2\ CO—C + CO_2$ | (air-carbon and cementite formation) |
| $2\ CO + Fe \ldots Fe_3C + CO_2$ | |

However, the addition or attachment of carbon-containing dust to the outer surface of the sponge iron provides no advantages, because this dust is e.g. rubbed off again in the following melt-down gasifier. Cementite formation is aided at elevated temperatures, but this only takes place to a limited extent. The (C) decomposition via the air-carbon reaction is aided at low temperatures.

Iron ore reduction takes place at temperatures of approximately 850° C. At such temperatures only little carbon can be separated from the reduction gas, particularly if its $CO_2$ content is above 3%. As a result of the process according to the invention, there is a two-stage process control, in which initially the iron ore is reduced at a temperature of approximately 850° C. and then the sponge iron produced is carburized at a lower temperature, i.e. preferably in the range 650° to 750° C.

The invention is described in greater detail hereinafter relative to non-limitative embodiments and the attached drawings, wherein show:

FIG. 1: an apparatus for producing pig iron from iron ore with a melt-down gasifier.

Figure 2:
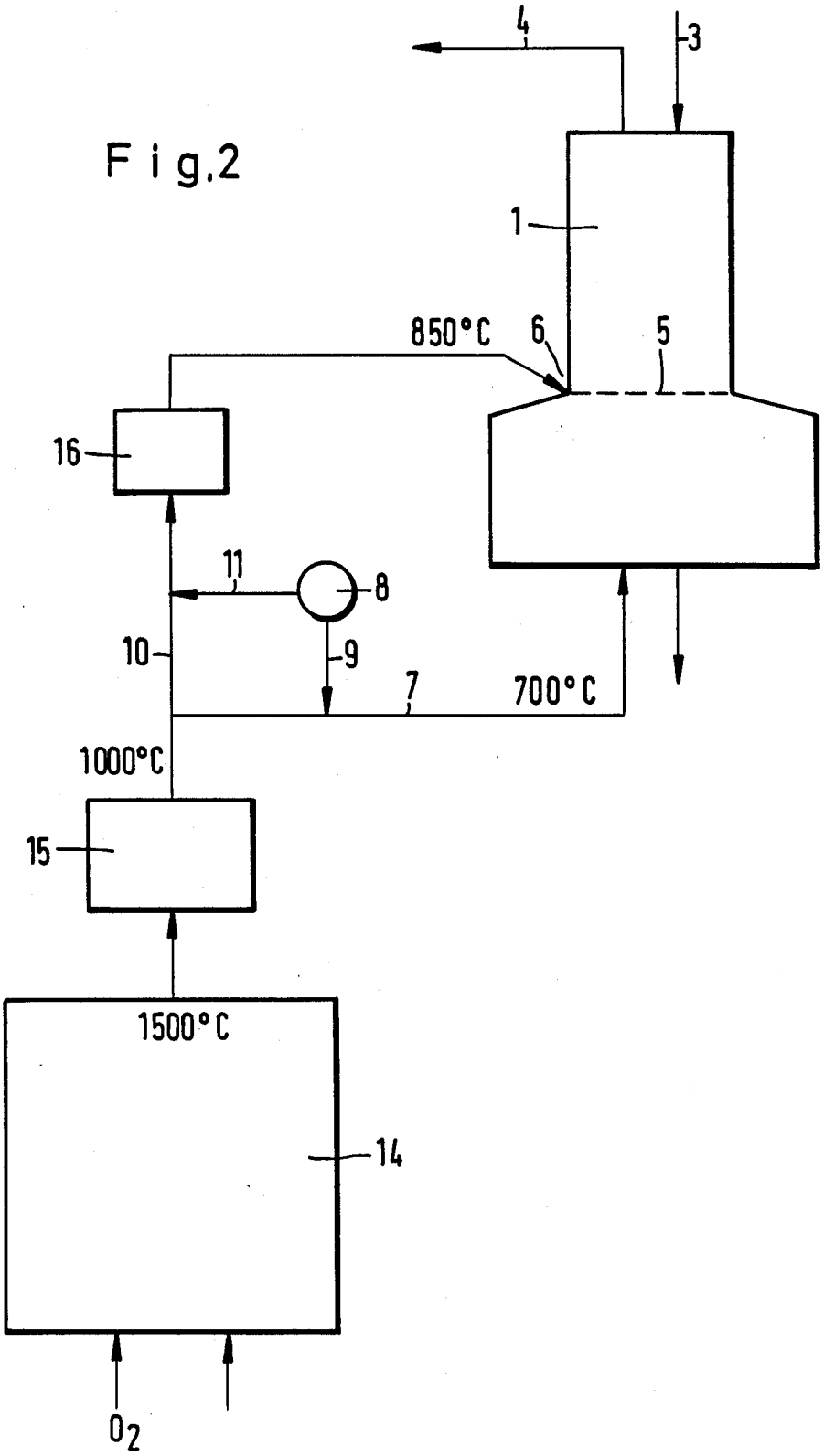

FIG. 2: an apparatus for producing sponge iron from iron ore with a coal-to-gas plant.

The apparatus diagrammatically shown in FIG. 1 is used for the direct production of molten pig iron from lump-type iron ore with a reduction furnace 1 and a melt-down gasifier 2. The iron ore is introduced into the upper part of shaft furnace 1 via an inlet 3, whilst the top gas produced in the shaft furnace is led out through an outlet 4 in the upper part of the furnace. The reduction of the iron ore supplied essentially takes place above the bustle plane 5, level with which reduction gas with a known composition and with a temperature of preferably 850° C. is introduced by means of inlets 6 arranged in annular manner round the circumference of the reduction shaft furnace 1.

Reduction shaft furnace 1 and the melt-down gasifier 2 positioned below are interconnected by downcomers 7, which on the one hand issue into openings in the bottom of furnace 1 and on the other hand into openings in the upper part of gasifier 2. They are used for transferring the sponge iron produced by the reduction of the iron ore from shaft furnace 1 into melt-down gasifier 2, as well as for conveying the reduction gas produced in the latter into the lower region of furnace 1. The reduction gas having a temperature of approximately 1000° C. in melt-down gasifier 2 is cooled to such an extent that it only has a temperature of approximately 700° C. on entering reduction shaft furnace 1. Cooling takes place by the admixing of a corresponding cooling gas quantity, which is introduced from a collecting main 8 via a line 9 into downcomers 7.

In addition, a line 10 leads reduction gas out of gasifier 2 and with it is admixed by means of a line 11 cooling gas in such a way that the gas has a temperature of approximately 850° C. The dust particles are removed therefrom in a cyclone separator 12 and is introduced in bustle plane 5 into reduction shaft furnace 1. The dust produced in cyclone separator 12 is returned via line 13 to the melt-down gasifier 2.

As a result of the different temperatures of the reduction gas introduced in different planes of shaft furnace 1, above the bustle plane 5 there is essentially a reduction and below said plane essentially a carburization of the sponge iron. However, as the carbon separation is not only dependent on the reaction temperature, but also the quantity of the reduction gas flowing through the downcomers 7 into furnace 1, as well as the residence time of the sponge iron in said gas flow, carbon separation can additionally be influenced by a corresponding dimensioning of the part of the reduction shaft furnace 1 positioned below the bustle plane. Another possibility of controlling the carburization in the lower are of shaft furnace 1 consists of a corresponding setting of the flow resistances for the two partial reduction gas flows. To make the gas flow through downcomers 7 as large as possible the pressure loss in cyclone separator 12 and the ratio of the cross-sectional surface of shaft furnace 1 below bustle plane 5 to the distance between the bustle plane and the inlets of the downcomers 7 in shaft furnace 1 can be increased. It must be borne in mind that it is not possible to regulate the partial flow quantities by means of regulating flaps in the case of the hot dust-containing gases. The ratio of the quantity of the reduction gas supplied through downcomers 7 to the quantity of the reduction gas supplied in bustle plane 5 is between 0.1 and 0.5, and is preferably 0.3. The flow resistance for the reduction gas to be supplied into bustle plane 5 is dimensioned in such a way that it corresponds to a pressure drop between 10 and 100 mbar.

The residence time of the reduced iron in the area between the bustle plane 5 and theinlets of downcomers 7 in the bottom of the reduction shaft furnace is between 1 and 4 hours and is preferably approximately 3 hours. The long residence time of the sponge iron in the reduction gas flow rising from downcomers 7 is obtained by a maximum volume of reduction shaft furnace 1 between bustle plane 5 and the plane in which the downcomers 7 issue into the shaft furnace. It must be borne in mind that if the distance between the two said planes is increased, although the shaft furnace volume in said area is correspondingly increased, the flow resistance for the rising reduction gas increases and the gas quantity is corresponding reduced. This problem can be solved in that the shaft cross-section below bustle plane 5 is increased, so that for a constant flow resistance, the volume of said area of shaft furnace 1 is increased. It is therefore necessary to seek a maximum volume of this furnace section, whilst simultaneously having a minimum spacing between the bustle plane and the lower reduction gas inlets. The ratio of the distance between bustle plane 1 and the inlets of downcomers 7 in the bottom of the shaft furnace to the diameter of said furnace in this area (H/F) is preferably between 0.5 and 1.0. Another control of the flow resistances can take place by a corresponding dimensioning of the line cross-section and by an additional pressure loss of the bustle.

In the apparatus according to FIG. 2, those parts corresponding to the apparatus of FIG. 1 are given the same reference numerals. The essential difference between these two apparatuses is that the apparatus according to FIG. 2 has a coal-to-gas plant 14 in place of a melt-down gasifier. In per se known manner, said plant produces the reduction gas required by the reduction shaft furnace 1 from coal and oxygen. As this has a temperture of approximately 1500° C. on leaving the plant 14, it is initially cooled in a waste heat system 15 to 1000° C. The reduction gas flow is then split up into two partial flows, introduction into reduction shaft furnace 1 taking place with one partial flow via line 10 after cooling to 850° C. by mixing with cooling gas supplied by line 11 and dust removal in a dust removing device 16 level with bustle plane 5 and in the case of the other partial flow after cooling to 700° C. by admixing with cooling gas supplied via line 9 in the base area of said furnace. The discharge openings for the sponge iron are separated from the inlets for the reduction gas in the bottom region of the shaft furnace. Here again, in the area located below bustle plane 5, shaft furnace 1 has a larger cross-section than in the upper area. Thus, carburization of the sponge iron is achieved here as in the same way as in the apparatus according to FIG. 1.

I claim:

1. A process of producing sponge iron from iron ore in a reduction shaft furnace having a top portion with an inlet for iron ore and an outlet for top gas, a base portion having an outlet for sponge iron, and a bustle plane between said two portions; comprising the steps of: introducing iron ore through said inlet into said top portion, for passage downward through said shaft furnace, introducing a first quantity of reducing gas containing CO from a melt-down gasifier or coal-to-gas plant into said furnace at said bustle plane with a first temperature of from 750° C. to 900° C. to reduce the iron ore, introducing a second quantity of reducing gas containing CO also from the gasifier or coal-to-gas plant into said base portion at a second temperature below that of said first quantity and in a temperature range of from 650° C. to 750° C., at which second temperature CO is separated into carbon and carbon dioxide to thereby carbonize the iron ore in said base portion to form sponge iron, removing the sponge iron through said outlet in said base portion, and removing top gas formed in said furnace through said outlet in said top portion.

2. A process according to claim 1, comprising maintaining the iron ore in said base portion for a time period of 1 and 3 hours.

3. A process according to claim 1, wherein the ratio of said second quantity to said first quantity is between 0.1 and 0.5.

4. A process according to claim 3, comprising establishing the ratio by restricting flow of the first quantity into said furnace more than that of the second quantity.

5. A process according to claim 4, wherein the flow of the first quantity is restricted to correspond to a pressure drop between 10 and 100 mbar.

6. A process according to claim 1, wherein the second quantity of reducing gas is cooled from a higher temperature prior to being introduced into said base portion.

7. A process according to claim 1, wherein said first quantity is cooled from a higher temperature prior to being introduced at said bustle plane.

8. A process according to claim 1, wherein limestone and/or dolomite is mixed with the iron ore for deacidification in the reduction shaft furnace above the bustle plane.

* * * * *